US005084987A

United States Patent [19]

Flemming

[11] Patent Number: 5,084,987

[45] Date of Patent: Feb. 4, 1992

[54] SHOE SOLE FOR SPORT SHOES

[75] Inventor: Udo Flemming, Erlangen, Fed. Rep. of Germany

[73] Assignee: Puma Aktiengesellschaft Rudolf Dassler Sport, Fed. Rep. of Germany

[21] Appl. No.: 400,685

[22] Filed: Aug. 30, 1989

[30] Foreign Application Priority Data

Feb. 3, 1989 [DE] Fed. Rep. of Germany ..... 8901235

[51] Int. Cl.[5] ..... A43B 13/18; A43B 13/12; A43B 21/26

[52] U.S. Cl. ..... 36/28; 36/30 R; 36/35 R

[58] Field of Search ..... 36/27, 28, 29, 30 R, 36/112, 114, 43, 44, 35 R

[56] References Cited

U.S. PATENT DOCUMENTS

| | | | |
|---|---|---|---|
| 532,429 | 1/1895 | Rogers | 36/28 |
| 1,598,809 | 9/1926 | Dressel | 36/28 |
| 2,347,207 | 11/1940 | Margolin | 36/44 X |
| 4,128,950 | 12/1978 | Bowerman et al. | 36/30 R |
| 4,133,118 | 1/1979 | Khalsa et al. | 36/29 |
| 4,224,747 | 9/1980 | Winfield | 36/30 R X |
| 4,245,406 | 1/1981 | Landay et al. | 36/30 R X |
| 4,359,830 | 11/1982 | Inohara | 36/29 |
| 4,391,048 | 7/1983 | Lutz | 36/30 R X |
| 4,481,726 | 11/1984 | Phillips | 36/30 R X |
| 4,506,461 | 3/1985 | Inohara | 36/29 |
| 4,712,314 | 12/1987 | Sigoloff | 36/112 |
| 4,843,741 | 7/1989 | Yung-Mao | 36/30 R |
| 4,845,863 | 7/1989 | Yung-Mao | 36/30 R |
| 4,881,328 | 11/1989 | Yung-Mao | 36/28 |

FOREIGN PATENT DOCUMENTS

| | | | |
|---|---|---|---|
| 138794 | 2/1920 | United Kingdom | 36/29 |

OTHER PUBLICATIONS

UK Patent Application 2201082A.

*Primary Examiner*—Paul T. Sewell
*Assistant Examiner*—Ted Kavanaugh
*Attorney, Agent, or Firm*—Sixbey, Friedman, Leedom & Ferguson

[57] ABSTRACT

Shoe sole for sport shoes with an outsole and a midsole of volume-compressible foamed material, as well as air cushions provided in the midsole is designed so that, on the one hand, the damping and, on the other hand, the restoring force, of the shoe sole, and thus the energy gain after release of the pressure from the shoe sole, is clearly improved. This is achieved in that the midsole (1) in the central area (2) under the heel bone (3), is provided with a honeycomb structure with individual honeycomb cells (4) that are integrally formed as part of the midsole (1) so as to open in a downward direction. These honeycomb cells (4) are sealed at their underside by an elastic cover (6).

20 Claims, 1 Drawing Sheet

FIG. 1
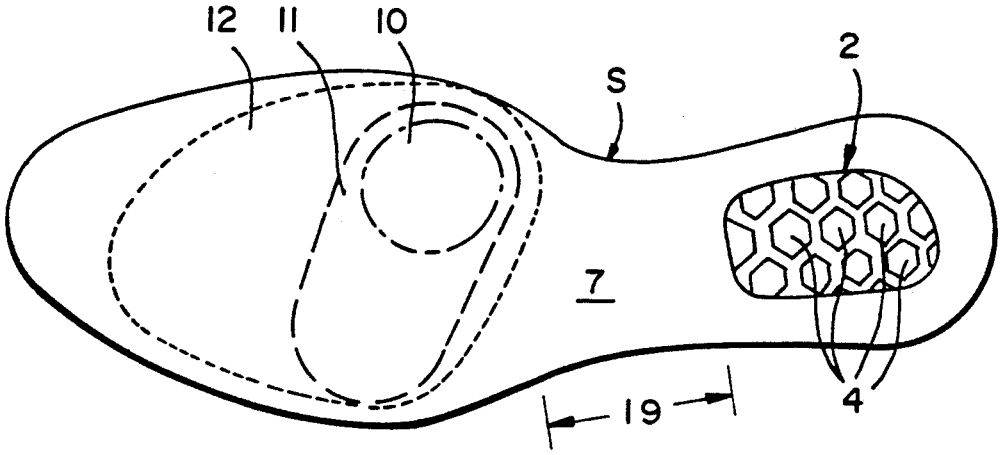
FIG. 2
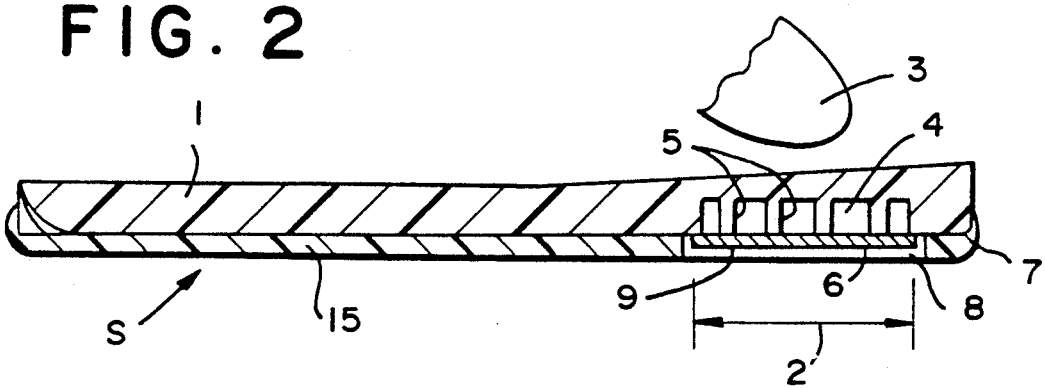
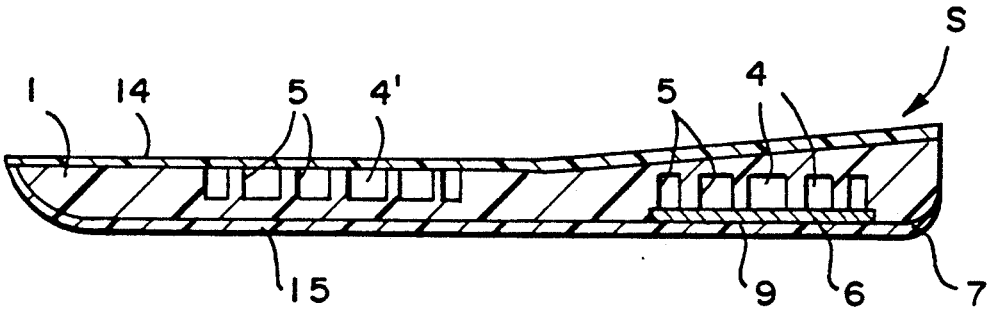
FIG. 3

SHOE SOLE FOR SPORT SHOES

BACKGROUND OF THE INVENTION

This invention relates to a shoe sole for athletic shoes with an outsole and a midsole of volume-compressible foamed material, as well as air cushions provided in the midsole.

A shoe sole for athletic shoes with a damping midsole is known, for example, from U.S. Pat. No. 4,486,964. In this previously known athletic shoe sole, four damping parts that are approximately round in an unweighted condition and contain air or gas, are placed next to one another with practically no distance between them in the heel area of the midsole. These parts are jointly sheathed by the foam material of the midsole; but, the spatial extension of these damping parts cannot be seen in detail. A disadvantage of this known embodiment of a shoe sole for athletic shoes is that the air/gas damping parts used there easily wear out and their restoring force is also insufficient.

U.S. Pat. No. 1,559,532 discloses a midsole or intermediate sole wherein the intermediate sole has soft (unfoamed rubber or other waterproof material), cellular projecting portions, one set at the sole and one set at the heel. The outer sole has box-like recesses, which correspond with and closely fit over the projecting cellular or resilient portions, which may be in the form of right-angular criss-cross webs in recticular fashion. On the other hand, when resilient projecting parts are provided on the intermediate sole which consist of sponge (foamed) rubber, a cellular structure with wide or extensive cells is not disclosed as being used. However, in either case, the resilient structures are formed as depending projections at the underside of the body of the intermediate sole that must be received in chambers formed in the outsole in order to create air cushions, and no provision is made for enabling the resilient or cellular structures to be viewable.

Soles having a window through which the midsole is viewable are known (see U.S. Pat. Nos. 4,481,727 and 4,694,591). However, these constructions are not used with honeycomb midsoles and the midsoles of these patents are intended to defect downwardly through the window opening into contact with the ground under the force of impacts.

SUMMARY OF THE INVENTION

It is, therefore, a primary object of this invention to improve a shoe sole for athletic shoes of the type initially mentioned so that, on the one hand, the damping and, on the other hand, the restoring force of the shoe sole, including the midsole, and thus the energy gain after release of pressure from the shoe sole, is clearly improved in comparison with those previously known.

It is a further object of the invention to achieve a sole with a volume-compressible foamed midsole within which a honeycomb air cushion structure is integrally formed in a recessed manner eliminating the need for coacting chambers to be formed in the outsole.

These and other objects according to the invention are obtained by such features as the arrangement of a honeycomb structure in the central area of the heel of the sole, recessed within the body of the midsole as an integral part of its compressible foamed material. As a result, on the one hand, a good damping and, on the other hand, a high restoring force is obtained, which is practically directly transmitted to the heel bone of the wearer. Thus, premature fatigue phenomena are lessened. Also a tilting of the foot inward or outward (overpronation or oversupination) is avoided, or at least is reduced, by the stabilizing of the midsole by the honeycomb structure.

Other advantageous details of the invention will become apparent from the following detailed description when viewed in conjunction with the accompanying figures of the drawings.

BRIEF DESCRIPTION OF THE DRAWINGS

FIG. 1 is a bottom view of an outsole with a window through which a honeycomb structure of the midsole is visible in accordance with a preferred embodiment of the invention;

FIG. 2 is cross-sectional view of the sole according to FIG. 1 with a honeycomb structure provided in the heel area; and FIG. 3 is a cross-sectional view of the sole according to FIG. 1 with honeycomb structures in both the forepart and heel areas of the sole.

DETAILED DESCRIPTION OF THE PREFERRED EMBODIMENT

In FIG. 1, a midsole 1 of a shoe sole for sports purposes is identified as S, which preferably consists of foamed plastic, especially a plastic with a base of polyethylene, polyurethane, ethylene-vinyl acetate or the like. The central part 2 of the area of the sole S which is located beneath the heel bone 3 of a wearer is shown in FIG. 2 as having a honeycomb structure formed within midsole 1. The honeycomb structure is integrally formed of the foamed material so as to be recessed within the body of the midsole 1, and is comprised of downwardly open honeycomb cells 4 which are defined by honeycomb cell walls 5.

As also shown in FIG. 2, the underside of the honeycomb structure is covered by a cover 6 which seals off honeycomb cells 4, preferably in a gastight manner. Thus, individual air or gas cushion cells are obtained, which, in connection with elastic honeycomb cell walls 5, produce good damping characteristics and, at the same time, exhibit a high restoring force. By this property of the recessed honeycomb structure, also a good lateral guiding of the foot, especially in the heel area, is assured, thereby avoiding or at least reducing overpronation or oversupination.

According to FIG. 2, outsole 7 is provided with a window 8 in the area beneath cover 6, so that cover 6 is visible. Preferably, cover 6 is made transparent or translucent so that the honeycomb structure becomes visible, thereby making it clear to the prospective purchaser that a honeycomb structure having damping and restoring force characteristics has been integrated within the midsole 1.

Cover 6, advantageously, projects into window 8 of outsole 7, so that bottom side 9 of cover 6 is either flush with that of outsole 7 or, preferably, is somewhat recessed below the ground contacting surface of the outsole 7, as shown in FIG. 2. Alternatively, as illustrated in FIG. 3, cover 6 may be positioned in a recessed manner within the midsole 1 so that its underside 9 is flush with the bottom surface of the sole, which can be advantageous when the midsole is joined to a preformed shell-like outsole instead of having the outsole 7 molded directly thereto.

As indicated in FIG. 3, a honeycomb structure, that preferably is upwardly open, can also be provided in at least a portion of the forefoot area 12 of the midsole 1 designated in FIG. 1, i.e., in just the area 10 of the ball of the big toe indicated by dot-dash lines, or in area 11 of the entire ball of the foot indicated by dash lines, or in the area 12 of the forefoot indicated by dotted lines in FIG. 1. Furthermore, while not shown, the honeycomb structure can also be provided in shank area 13, delimited by arrows in FIG. 1, as this is represented in detail by the embodiment of FIG. 3.

The upwardly open honeycomb cells 4' of this honeycomb structure can be sealed by an upper sole 14, especially in a gastight manner. Thus, in the forefoot area, a good damping with high restoring force, or in the shank area a reduction of the weight of midsole 1 is also obtained.

Preferably, midsole 1 has a hardness of 20 to 40 Shore A. Preferably, the hardness of honeycomb walls 5 (FIGS. 2 and 3) is, for example, about 5 to 10 Shore A greater than that of the body part of midsole 1.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. Shoe sole for athletic shoes comprising an outsole and a midsole having a body portion made of volume-compressible foamed material, as well as air cushions provided in the midsole, wherein the air cushions in the midsole are formed, in a central heel area of the sole, by a honeycomb structure that is an integrally molded part of the body portion of the midsole which is recessed within the foamed material of said body portion; wherein said honeycomb structure has individual downwardly open honeycomb cells; and wherein an elastic cover is provided recessed within the body portion of the midsole as a means by which the honeycomb cells are covered and sealed at an underside thereof.

2. Shoe sole according to claim 1, wherein a window is provided in the outsole below at least a portion of the elastic cover as a means for rendering the cover visible through the outsole.

3. Shoe sole according to claim 1, wherein a bottom side of the midsole is flush with a bottom side of the cover.

4. Shoe sole according to claim 3, wherein a window is formed in the outsole in an area of the elastic cover and the cover projects into said window.

5. Shoe sole according to claim 4, wherein the cover is formed of one of a transparent and a translucent material of said body portion.

6. Shoe sole according to claim 5, wherein the cover seals the underside of the honeycomb cells in a gastight manner.

7. Shoe sole according to claim 1, wherein said foamed material of said body portion consists of foamed polyurethane.

8. Shoe sole according to claim 1, wherein said foamed material of said body portion consists of foamed ethylene-vinyl acetate.

9. Shoe sole according to claim 1, wherein the foamed material of said body portion has a hardness of 20 to 40 shore A.

10. Shoe sole according to claim 1, wherein walls of said honeycomb cells have a greater hardness than remaining material of midsole.

11. Shoe sole according to claim 1, wherein a second honeycomb structure with upwardly open honeycomb cells is formed as an integrally molded part of the midsole recessed within the foamed material of said body portion in a forefoot portion in at least an area of a ball of the big toe, said second honeycomb structure being covered by an upper sole.

12. Shoe sole according to claim 11, wherein said upper sole seals the honeycomb cells of the second honeycomb structure in a gastight manner.

13. Shoe sole according to claim 2, wherein a second honeycomb structure with upwardly open honeycomb cells is formed as an integrally molded part of the midsole recessed within the foamed material of said body portion in a forefoot portion in at least an area of a ball of the big toe, said second honeycomb structure being covered by an upper sole.

14. Shoe sole according to claim 13, wherein said upper sole seals the honeycomb cells of the second honeycomb structure in a gastight manner.

15. Shoe sole according to claim 14, wherein the cover is formed of one of a transparent and a translucent material of said body portion.

16. Shoe sole according claim 15, wherein the cover seals the underside of the honeycomb cells in a gastight manner.

17. Shoe sole according to claim 16, wherein said foamed material consists of foamed polyurethane.

18. Shoe sole according to claim 16, wherein said foamed material of said body portion consists of foamed ethylene-vinyl acetate.

19. Shoe sole according to claim 16, wherein the foamed material of said body portion has a hardness of 20 to 40 Shore A.

20. Shoe sole according to claims 16, wherein walls of said honeycomb cells have a greater hardness than remaining material of midsole.

* * * * *